US009346259B2

(12) United States Patent
Michels et al.

(10) Patent No.: US 9,346,259 B2
(45) Date of Patent: May 24, 2016

(54) INK CONTROL METHOD FOR PRINTING PRESSES HAVING SHORT INKING UNITS

(75) Inventors: Jürgen Michels, Ladenburg (DE); Dieter Schaffrath, Lorsch (DE); Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 324 days.

(21) Appl. No.: 13/022,815

(22) Filed: Feb. 8, 2011

(65) Prior Publication Data

US 2011/0192305 A1 Aug. 11, 2011

(30) Foreign Application Priority Data

Feb. 8, 2010 (DE) ..... 10 2010 007 199

(51) Int. Cl.
*B41F 33/00* (2006.01)

(52) U.S. Cl.
CPC ..... *B41F 33/0045* (2013.01)

(58) Field of Classification Search
CPC ..... B41F 33/0045; B41F 31/045; B65H 2557/2644
USPC ..... 101/492, 483, DIG. 47, DIG. 45, 364
See application file for complete search history.

(56) References Cited

U.S. PATENT DOCUMENTS

| | | | | |
|---|---|---|---|---|
| 3,527,164 | A | 9/1970 | Bulk | |
| 4,346,446 | A * | 8/1982 | Erbstein et al. | 702/182 |
| 4,464,615 | A | 8/1984 | Rodi | |
| 4,717,954 | A * | 1/1988 | Fujita et al. | 358/523 |
| 6,752,081 | B2 | 6/2004 | Callahan et al. | |
| 7,004,070 | B2 | 2/2006 | Schneider et al. | |
| 7,021,215 | B2 | 4/2006 | Schneider et al. | |
| 7,089,855 | B2 | 8/2006 | Schneider et al. | |
| 7,143,695 | B2 | 12/2006 | Schneider et al. | |
| 7,261,034 | B2 | 8/2007 | Scheider et al. | |
| 7,389,728 | B2 | 6/2008 | Hieronymus et al. | |
| 7,409,910 | B2 | 8/2008 | Schneider et al. | |

(Continued)

FOREIGN PATENT DOCUMENTS

| | | | |
|---|---|---|---|
| DE | 3148947 | A1 | 6/1983 |
| DE | 4229267 | A1 | 3/1994 |
| DE | 10232110 | A1 | 3/2003 |
| DE | 19736339 | B4 | 3/2004 |
| DE | 10254501 | A1 | 5/2004 |
| DE | 202004015565 | U1 | 12/2004 |

(Continued)

OTHER PUBLICATIONS

German Search Report dated Oct. 12, 2010.

*Primary Examiner* — Jennifer Simmons
(74) *Attorney, Agent, or Firm* — Laurence A. Greenberg; Werner H. Stemer; Ralph E. Locher

(57) ABSTRACT

A method for closed-loop or open-loop control of ink feed in lithographic offset printing presses having at least one inking unit, a control unit and an operating element for adjusting the ink feed across a predetermined ink feed control range, includes subdividing the predetermined control range into partial ranges in the control unit. At least one adjustment parameter of the inking unit or the printing press is assigned to each partial range in the control unit. The control unit determines the appropriate partial range as a function of the ink feed selected with the operating element and adjusts the selected ink feed in the inking unit with associated adjustment parameters in the inking unit and/or in the printing press.

9 Claims, 7 Drawing Sheets

(56) References Cited

U.S. PATENT DOCUMENTS

| | | | | |
|---|---|---|---|---|
| 7,464,645 | B2 * | 12/2008 | Jeschonneck et al. | 101/484 |
| 7,574,957 | B2 | 8/2009 | Baumgarten et al. | |
| 2005/0005803 | A1 | 1/2005 | Schneider | |
| 2007/0144375 | A1 | 6/2007 | Jeschonneck | |

FOREIGN PATENT DOCUMENTS

| | | | |
|---|---|---|---|
| DE | 102008009300 | A1 | 8/2009 |
| EP | 0124908 | A2 | 11/1984 |
| GB | 1209545 | A | 10/1970 |
| WO | 03045695 | A1 | 6/2003 |

* cited by examiner

| Adjustment (mm) | 0.16 | 0.18 | 0.20 | 0.23 |
|---|---|---|---|---|
| Strip Width (mm) | 5.4 | 6.0 | 6.6 | 7.3 |

INK CONTROL METHOD FOR PRINTING PRESSES HAVING SHORT INKING UNITS

CROSS-REFERENCE TO RELATED APPLICATION

This application claims the priority, under 35 U.S.C. §119, of German Patent Application DE 10 2010 007 199.4, filed Feb. 8, 2010; the prior application is herewith incorporated by reference in its entirety.

BACKGROUND OF THE INVENTION

Field of the Invention

The present invention relates to a method for closed-loop or open-loop control of the ink feed in lithographic offset printing presses having at least one inking unit, a control unit and an operating element for adjusting the ink feed across a predetermined control range of the ink feed.

In lithographic offset printing presses, adjusting the ink feed is crucial in obtaining optimum print quality. In every printing operation, the most important aspect is to create prints that correspond to the original as closely as possible, in particular in terms of color. There are color deviations between the printed product and the original that are visible to the naked eye of a person skilled in the art. Small deviations are noticeable only through the use of color measuring devices. If unacceptable deviations are present between the original and the printed product, the ink feed in the lithographic offset printing press must be adjusted. The ink feed in lithographic offset printing presses depends on many different technical parameters, a fact which makes a correct setting of the ink feed subject to errors. For that reason, modern lithographic printing presses have control loops, also referred to as feedback control systems, which automatically control the ink feed by accessing certain values such as the ink layer thickness in the inking unit of the printing press and modifying corresponding settings of the inking unit. If the printing press has an ink fountain that includes a number of ink zones across the entire width of the printing substrate, ink-layer-based ink feed control is sufficient. In short inking units of the anilox type, however, such ink zones and corresponding ink keys for controlling ink layer thickness are not available. Consequently, other parameters must be used to control the ink feed.

German Published Patent Application DE 102 54 501 A1 corresponding to U.S. Pat. Nos. 7,409,910; 7,261,034; 7,143,695, 7,089,855, 7,021,215; and 7,004,070, discloses a method of controlling the ink feed in short inking units of web-fed lithographic offset printing presses. The disclosed method uses inking unit temperature and machine speed as control variables for controlling the ink feed. In that context, the machine speed is used as a command variable for feedback temperature control. The temperature of the inking unit is increased when the machine speed increases to avoid disturbing side effects. For lithographic printing presses, it is known that the inking depends on the temperature of the inking unit and on the machine speed. In the aforementioned document, the temperature is adjusted as a function of the printing speed in such a way that the features of the printing ink remain as constant as possible to achieve optimum printing results.

German Patent DE 197 36 339 B4 discloses a printing press with a short inking unit in which the application of the ink film can be modified during printing by modifying the temperature in the printing unit. That is a way to adjust the amount of ink that is being applied and thus to modify the colors by adjusting the temperature.

In addition to the aforementioned parameters of temperature and printing speed, there are a number of other parameters which influence the ink feed in lithographic offset printing presses. A considerable disadvantage of that fact is that the printing press operator must make a number of inputs by hand without being certain of the effect each parameter has on the ink feed, thus causing faulty settings of the ink feed to be inevitable. Moreover, especially in offset printing presses that have short inking units of the anilox type, the adjustment and control range of the ink feed is unnecessarily limited if the technical parameters are adjusted in an uncorrelated manner.

SUMMARY OF THE INVENTION

It is accordingly an object of the invention to provide an improved method for closed-loop or open-loop control of an ink feed, in particular in lithographic offset printing presses having short or anilox inking units, which overcomes the hereinafore-mentioned disadvantages of the heretofore-known methods of this general type and which ensures a comfortable and reliable setting of the ink feed by a printing press operator independently of various influencing parameters.

With the foregoing and other objects in view there is provided, in accordance with the invention, a method for closed-loop or open-loop control of an ink feed in an offset printing press having at least one inking unit, a control unit and an operating element for adjusting the ink feed across a predetermined ink feed control range. The method comprises subdividing the predetermined ink feed control range into partial ranges in the control unit, assigning at least one adjustment parameter of the at least one inking unit or of the printing press to each of the partial ranges in the control unit, determining, with the control unit, an appropriate partial range as a function of the ink feed selected by the operating element, and setting, with the control unit, the selected ink feed in the at least one inking unit using the respective associated adjustment parameters in the at least one inking unit and/or the printing press.

In accordance with the present invention, the printing press includes a control unit which provides closed-loop or open-loop control (with or without feedback) of the ink feed in the inking unit of the lithographic offset printing press. For this purpose, the predetermined control range from the minimum ink feed to the maximum ink feed is subdivided into partial ranges. At least one adjustment parameter of the inking unit or the printing press is assigned to each partial range in the control unit. These adjustment parameters are the technical parameters indicated above, such as the temperature or the machine speed. Thus, the control unit stores unequivocal information as to which technical parameters in the offset printing press need to be modified for which partial range of the entire control range of the ink feed in order to adjust the ink feed in the desired partial range or to set the desired value in the partial range, respectively. For this purpose, the control unit determines the adequate partial range as a function of the ink feed selected through the use of an operating device and then, using the adjustment parameters assigned to the adequate partial range, sets the ink feed that was selected through the use of the operating device. A considerable advantage of this is that when the printing press operator sets the ink feed, he or she does not have to think about which technical or adjustment parameters he or she will have to modify to achieve an ink feed in a certain partial range. For instance, it is no longer necessary for him or her to know whether he or she will have to modify the printing press speed or the temperature in the inking unit. All he or she needs to do is to select the desired ink feed. Then, the control unit assigns the corresponding parameter of machine speed or temperature, thus ensuring that the correct adjustment parameters will be modified at all times to obtain the selected ink feed.

In accordance with another mode of the invention, a suitable input parameter for the one operating device is the color density in the inking unit which may, for instance, be set in percentages or in diode units as in zonal inking units in traditional sheet-fed lithographic offset printing presses.

In accordance with a further mode, the present invention is particularly suited for use in short inking units such as anilox inking units, in which the ink layer thickness in the inking unit cannot be controlled through the use of zonal ink metering elements. In these short inking units, the ink feed can only be modified through the use of other technical parameters such as the temperature or machine speed.

In accordance with an added mode of the invention, the method of closed-loop or open-loop control of the ink feed in offset printing presses may operate in a completely automatic way, i.e. the feedback control of the ink feed in the inking unit may be carried out in a fully automated way by the control unit. The method may likewise operate in a semi-automatic way, i.e. the control unit may initially determine the appropriate technical parameter and the associated partial range, which may then be displayed for the printing press operator to make this setting by hand. This alternative is particularly suited for retrofitting printing presses that do not have automatic ink control.

In accordance with an additional mode of the invention, an advantage of the fully automated ink control is that the color on a printing substrate is measured by a color measuring device. Then the control unit carries out a comparison between the measured actual color value and the desired color value, and compensates for possible deviations between the actual value and the desired value by influencing the ink feed in the partial ranges. In accordance with this alternative, desired color values of the original are compared to actual color values measured on the printed substrates in order for the control unit to calculate color differences between the desired color values and the actual color values and to make the corresponding adjustments in the printing press. In this context the measurements on the printing substrates may be taken outside the printing press or inside the printing press through the use of an inline color measuring device. It is preferable for the color measuring devices to be networked with the control unit of the printing press to be able to compensate for deviations between desired color values and actual color values in a fully automated way without the printing press operator's interference.

In accordance with yet another mode of the invention, in experiments, the technical parameters for adjusting the ink feed through the color density cover different partial ranges. Thus, in the respective partial range, the color density can be modified by 0.5 DV (full-tone density or color density in the solid) through the use of the temperature, by 0.15 DV through the use of the machine speed, by 0.2 DV through the use of the contract strip pressure, and by 0.1 DV by throwing the rider rollers on and off.

In accordance with yet a further mode of the invention, as a rule, however, the printing press operator will input the color density in percentages. For this purpose, the operating element has an appropriate scale or input field which the printing press operator can use to input the desired color density in percent. Again, each technical parameter is assigned a partial range. Preferably, the area of temperature adjustment is assigned to the partial range of between 50 and 100%, the area of contact strip pressure to the partial range of between 100 and 120%, the adjustment of the machine speed to the partial range of between 120 and 135%, and the throwing off of the rider rollers to the partial range of between 40 and 50%. Depending on which percentage the operator has input through the use of the operating element, the control unit selects the associated partial range and the appropriate technical parameter to obtain the desired percentage of the color density.

In accordance with yet an added mode of the invention, the inking unit is a short inking unit without zones and for each inking unit of the printing press only one actual color value is determined through the use of a color measuring device and is compared to only one predetermined desired color value. Since short inking units without zones do not have different ink zones across the entire width, the ink feed can only be modified across the entire width and not in individual zones. For this reason, it is sufficient to determine only one actual color value in each measuring operation in each inking unit and to compare it to a corresponding desired color value of the original. As a result, relatively few actual color values need to be measured, and accordingly the color measuring device can be of simple construction.

In accordance with a concomitant mode of the invention, if the machine speed of the printing press is reduced to adjust the color density, the control unit may provide an optical or acoustic signal to inform the machine operator of the fact that the maximum production speed of the printing press is no longer available. If the operator has selected a setting of the color density which requires the control unit to reduce the machine speed in order to attain the setting, the maximum production speed will no longer be available. In order to prevent the printing press operator from being surprised by this speed reduction and from trying to re-increase the machine speed, he or she is given an optical or acoustic warning signal indicating a reduction of the machine speed for the purpose of adjusting the color density. This aspect prevents the printing press operator from being annoyed when he or she realizes that the printing press runs at a lower speed than he or she originally intended because the ink feed he or she selected cannot be achieved at the maximum production speed of the printing press.

Other features which are considered as characteristic for the invention are set forth in the appended claims.

Although the invention is illustrated and described herein as embodied in an ink control method for printing presses having short inking units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
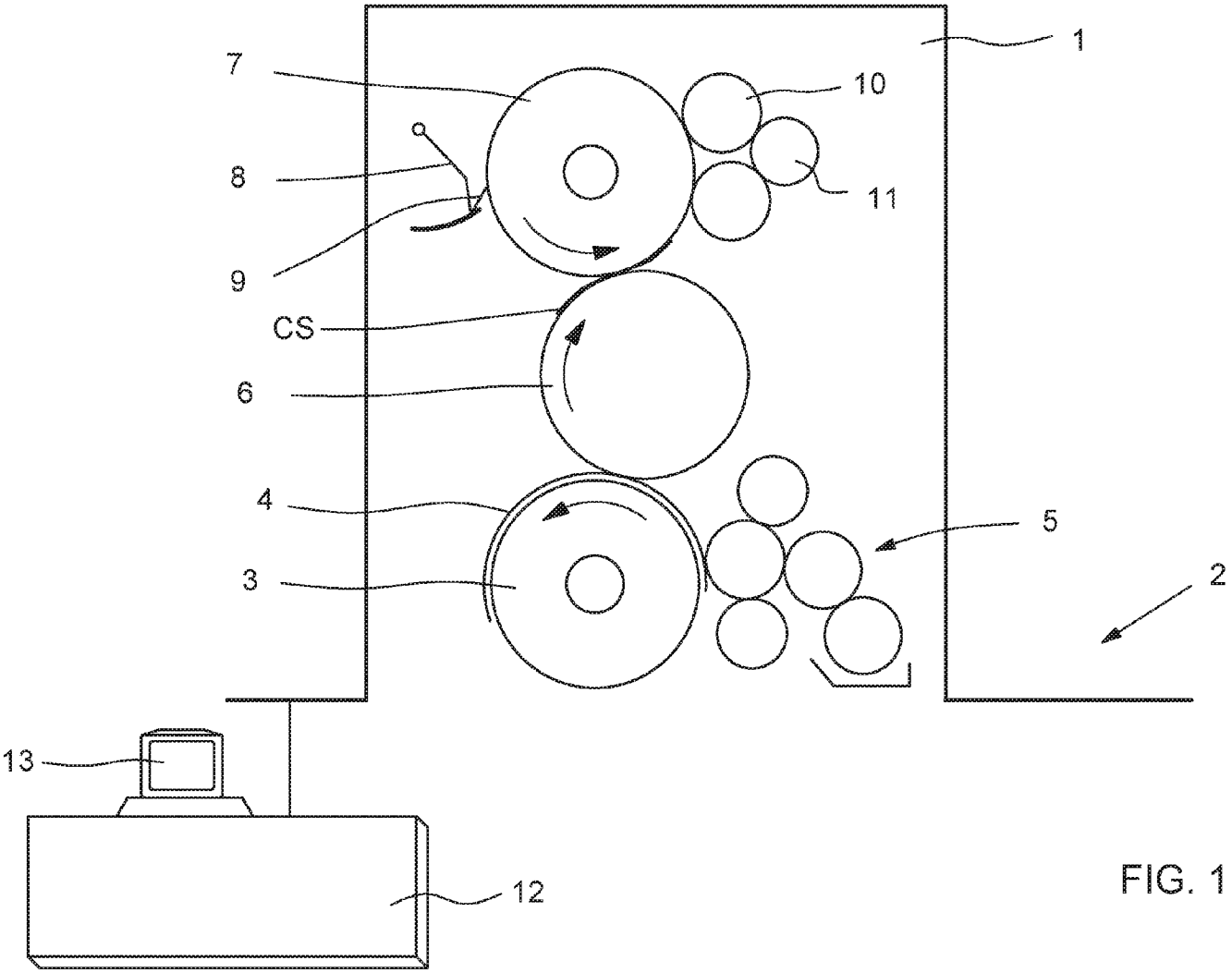
FIG. 1 is a diagrammatic, sectional view of a short inking unit in a lithographic offset printing press having a control unit.

Referring now to the figures of the drawings in detail and first, particularly, to FIG. 1 thereof, there is seen a diagrammatic representation of a short inking unit 1 of the anilox type in a sheet-fed lithographic offset printing press 2. Anilox inking units 1 are mainly used in web-fed rotary printing presses such as newspaper presses, but are becoming increasingly common in sheet-fed offset printing presses 2 due to a number of advantages. The anilox inking unit 1 shown in FIG. 1 is substantially formed of a screen roller 7, which takes up printing ink from an ink fountain. Rider rollers 10 and ink distributor rollers 11 create a predetermined ink film on the screen roller 7. The screen roller 7, with its cells, interacts with an ink applicator roller 6, which smoothes the ink and transfers it to a downstream plate cylinder 3 in the printing unit. A contact strip CS is shown between the screen roller 7 and the ink applicator roller 6. The plate cylinder 3, which carries a printing plate 4, may additionally be provided with dampening solution from an adjacent dampening unit 5 to achieve a desired ink consistency on the printing plate 4. In order to adjust the amount of ink the screen roller 7 takes up from the ink fountain, chambered doctor blades 8 and doctor blades 9 are provided which interact directly with the screen roller 7. Non-illustrated servomotors are provided to throw the rider rollers 10 and the ink distributor rollers 11, as well as the dampening unit 5, on and off the screen roller 7.

Figure 2:
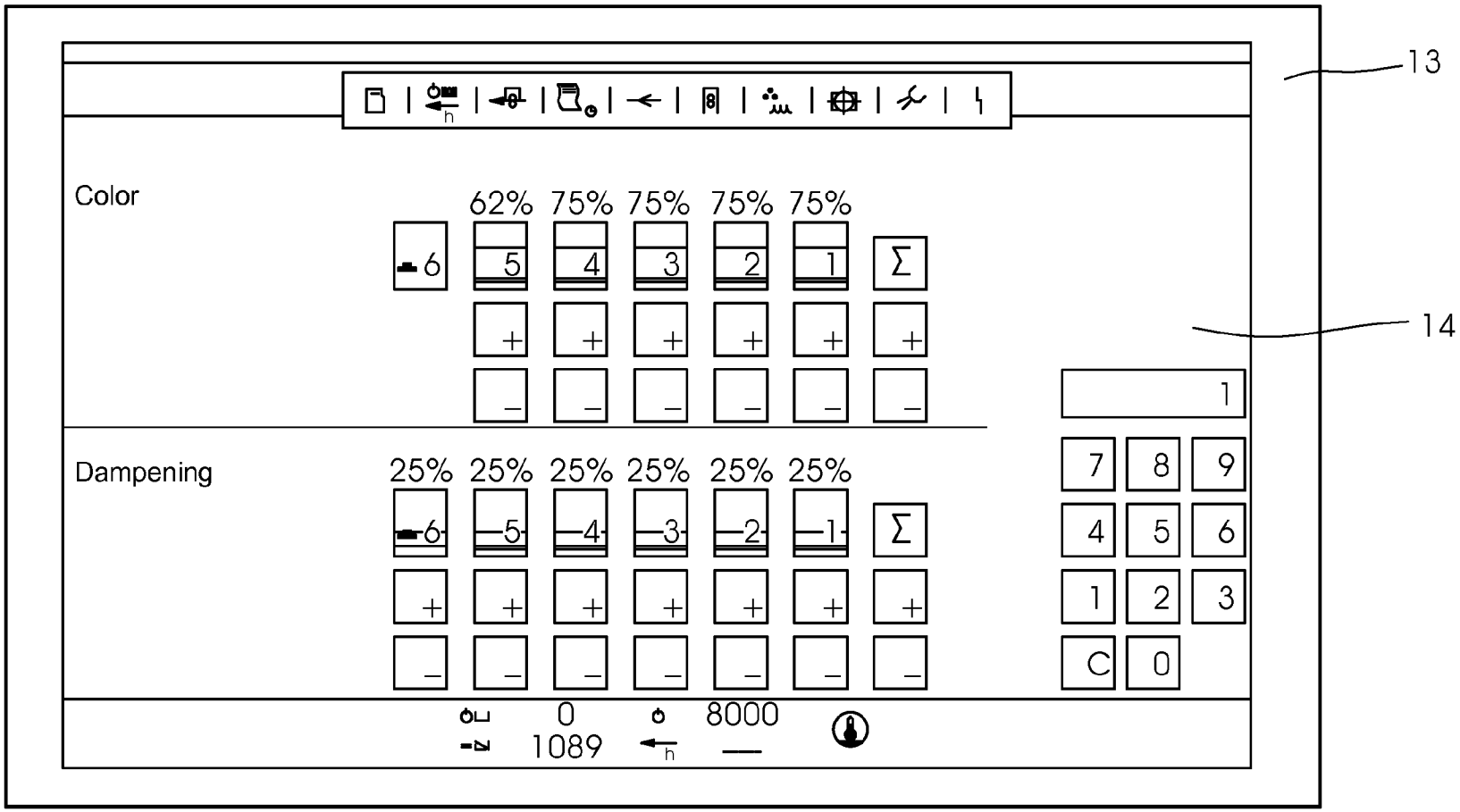
FIG. 2 is an elevational view of an input mask of the control unit for inputting color density in percent.

These servomotors are controlled by a control unit or computer 12, like all other servomotors and a main drive motor of the printing press 2. The control unit 12 has a touch screen 13, which displays a user interface 14 as shown in FIG. 2, in order to display the state of the printing press 2 and to receive operator commands from a pressman. The control unit 12 can also be used to control the printing speed of the printing press 2 and to modify the temperature of the inking unit rollers 6, 7, 10, 11. Temperature modification may be achieved through the use of non-illustrated fluids which are pumped through the respective rollers 6, 7, 10, 11.

FIG. 2 is an enlarged representation of an input screen of the user interface 14 for inputting the desired color density. As can be seen, a different color density can be set on the touch screen 13 for each printing unit and thus for each process color. In FIG. 2, the color density is input in terms of percentages. In accordance with the diagram of FIG. 7, the control unit 12 selects the appropriate partial range as a function of the input percentage. If an input of 75 percent was made, the control unit 12 would thus select the temperature adjustment range and adjust the temperature of the inking units in a corresponding way to obtain the desired percentage of 75.

Figure 3:
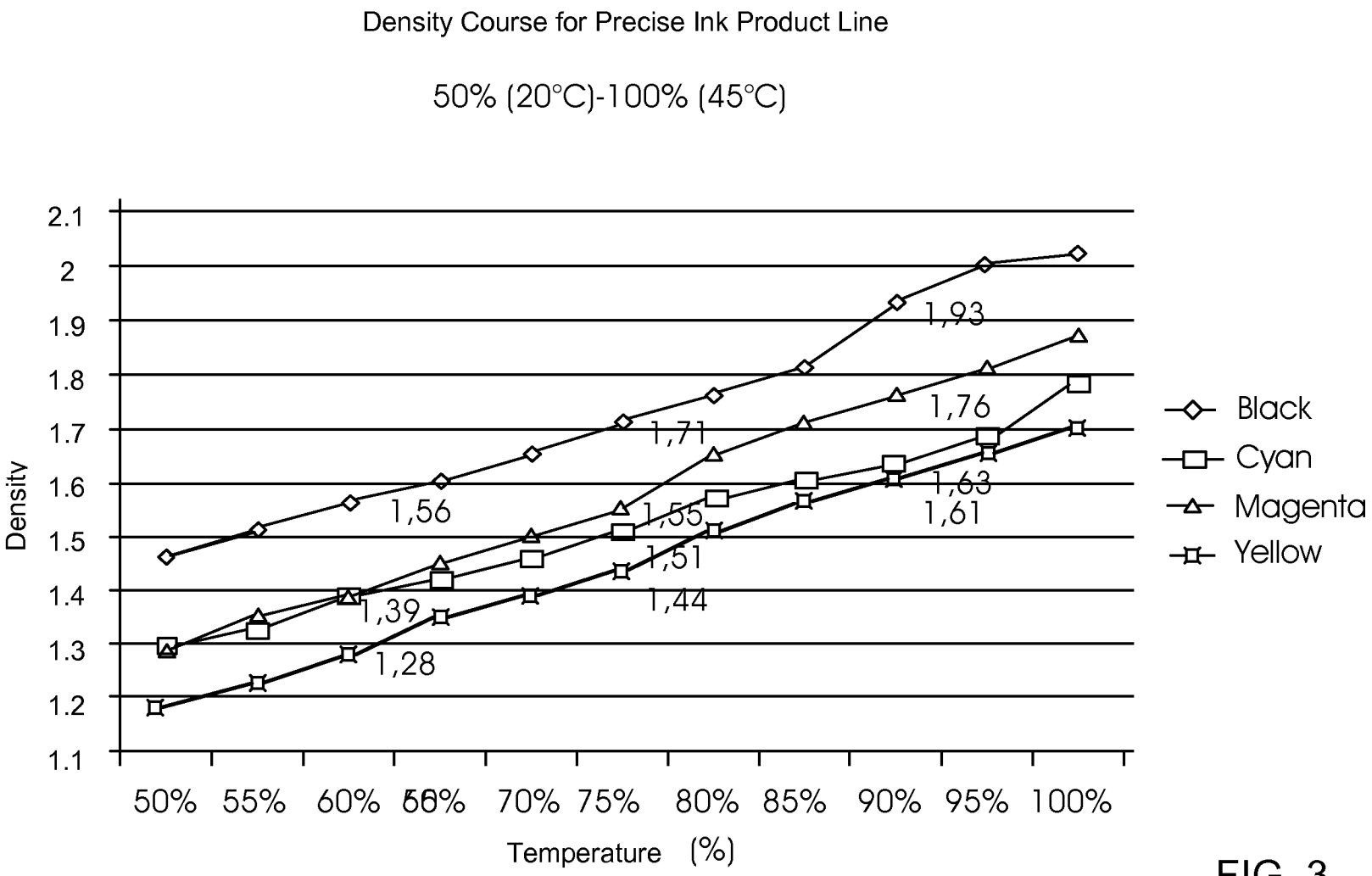
FIG. 3 is a graph illustrating an exemplary progression of the color density between 50 and 100% as a function of temperature for ink of a Precise S product line.

By way of example, FIG. 3 illustrates a progression of the color density across a temperature adjustment range of between 50 and 100 percent for ink of the Precise S product line. The density progressions of the process colors black, cyan, magenta, and yellow are shown. The diagram shows that the color density can be influenced in percentages by adjusting the temperature. A color density of 50 percent corresponds to a temperature of 68° F. (20° C.), and a color density of 100 percent corresponds to a temperature of 113° F. (45° C.). As can be seen, from 50 to 100 percent, the temperature adjustment range covers a wide range and is consequently the preferred adjustment range, in particular because a temperature adjustment does not affect the operating speed of the printing press.

Figure 4:
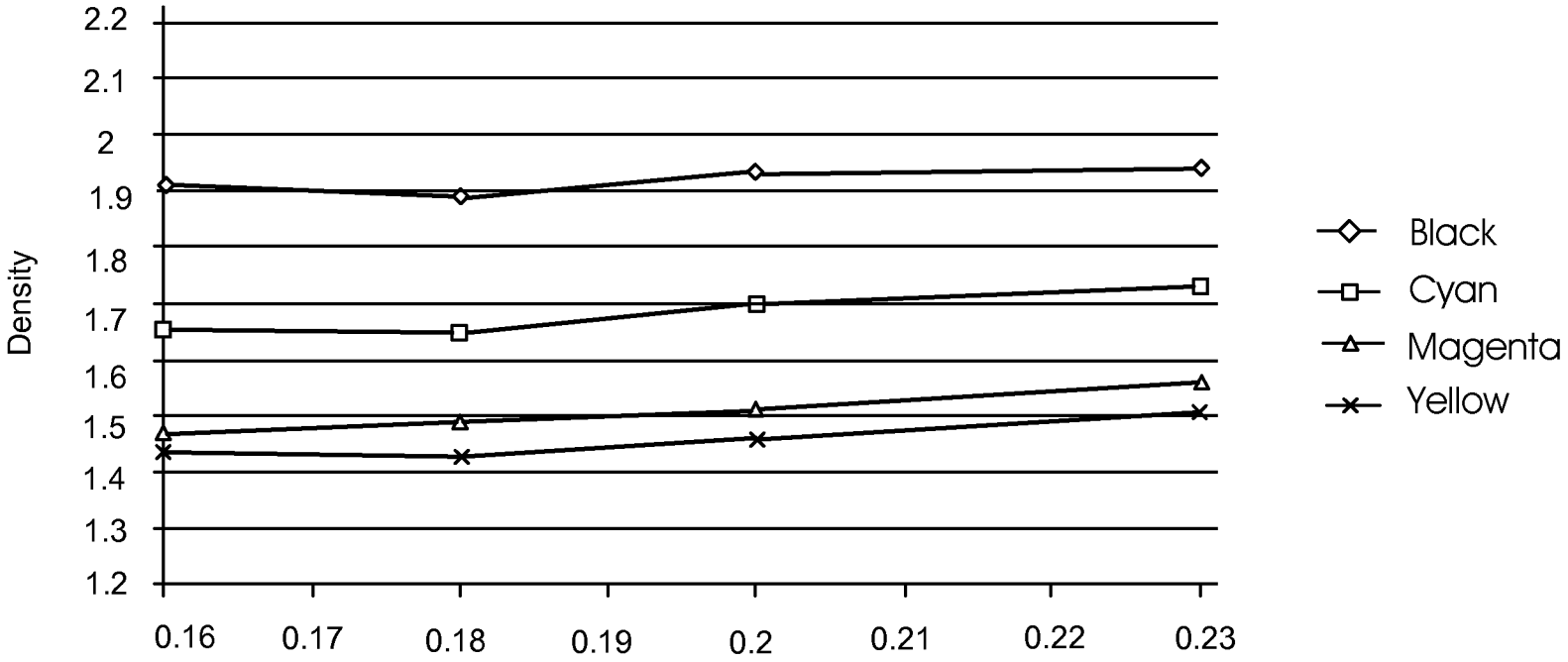
FIG. 4 is a graph illustrating dependence of the color density on a contact strip pressure per contact strip for ink of the Precise S product line.

FIG. 4 illustrates the influence of the contract strip pressure on the color density, again based on the four process colors black, cyan, magenta, yellow of the Precise S product line. An adjustment of the contact strip pressure covers the range of between 100 and 120 percent.

Figure 5:
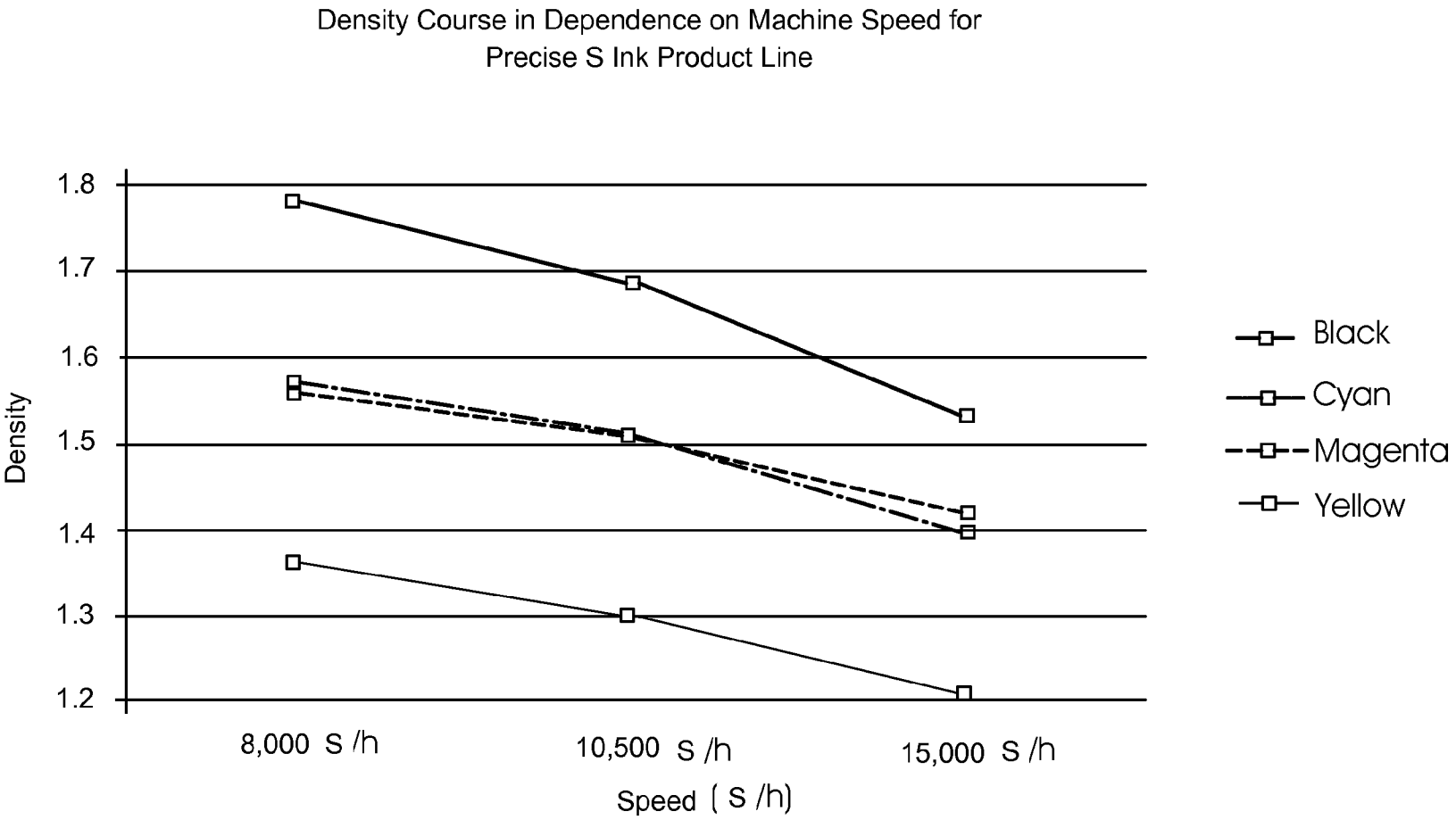
FIG. 5 is a graph illustrating progression of the color density as a function of machine speed for ink of the Precise S product line.

A further partial range, which is shown in FIG. 5, illustrates the color density progression as a function of the printing press speed, again for the four process colors black, cyan, magenta, yellow of the Precise S product line. This partial range covers the range of between 120 and 135 percent of the full-tone density or color density in the solid. However, a considerable disadvantage of a reduction of the machine speed is that the productivity of the printing press 2 decreases. For this reason, pressmen avoid this range if possible. Yet a reduction of the machine speed is an option for expanding the adjustment range of the ink feed beyond 120 percent and thus obtaining a wider adjustment range of the ink feed. If the control unit 12 reduces the machine speed in the color density range of between 120 and 135 percent, this fact is displayed to the operator on the touch screen 13 by a flashing element to prevent him or her from being surprised by the fact that the printing press 2 is running at a lower speed and from re-increasing the speed out of ignorance because he or she thinks that the printing press has not yet reached the full production speed and tries to correct this manually.

Figure 6:
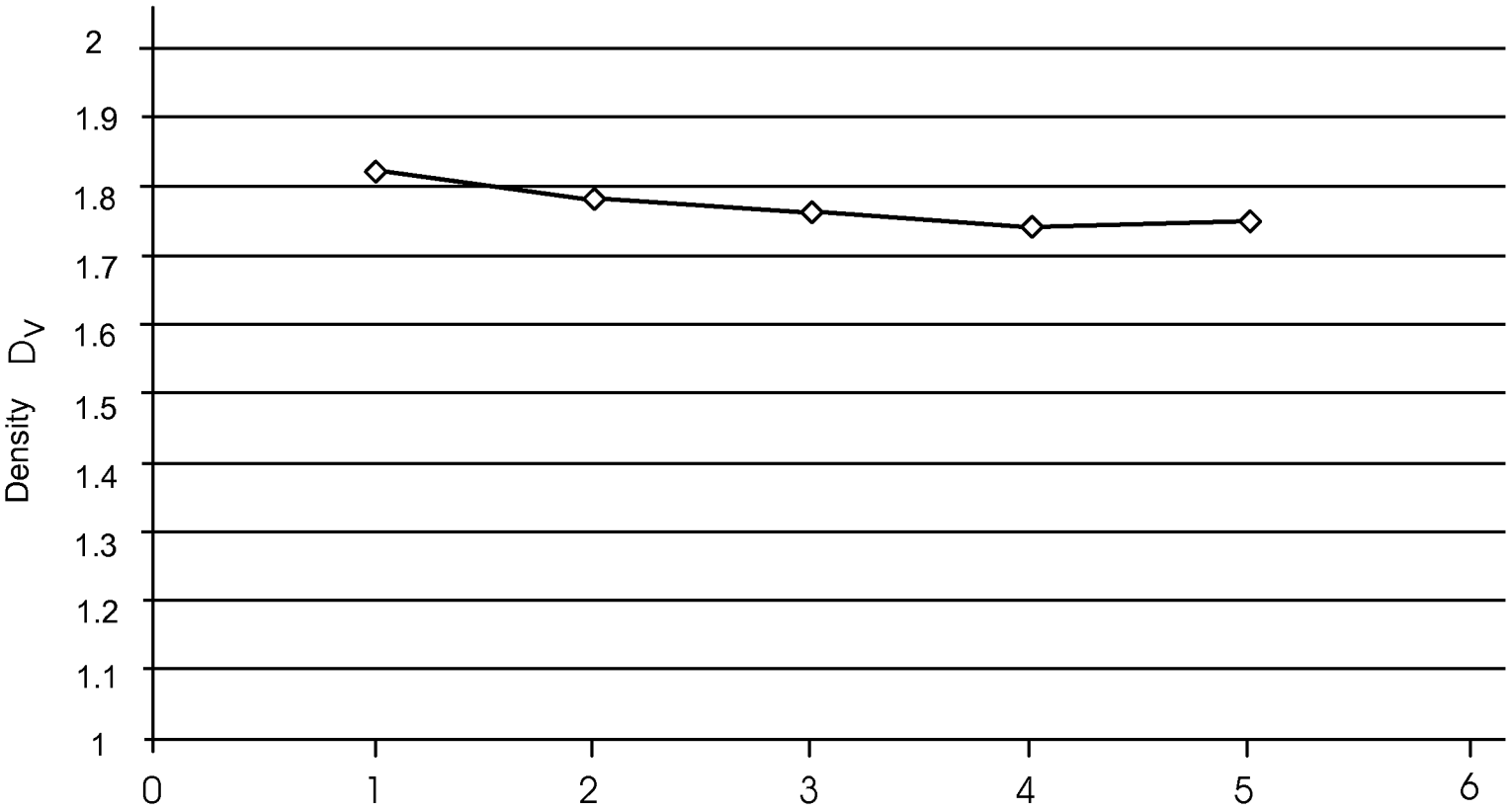
FIG. 6 is a graph illustrating progression of the color density as a function of spacing of rider rollers in the inking unit for ink of the Precise S product line.

FIG. 6 plots the color density as a function of the spacing between the rider rollers 10 and the screen roller 7. This partial range covers the range of between 40 and 50 percent of the full-tone density or color density in the solid.

Figure 7:
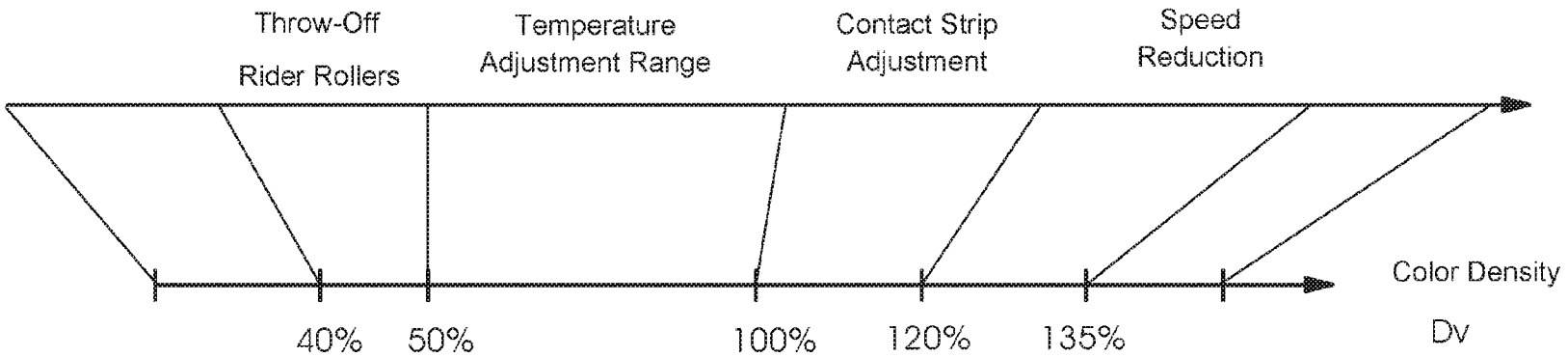
FIG. 7 is a chart illustrating an entire adjustment range for adjustment of the ink feed in the offset printing press with its partial ranges assigned to respective technical parameters.

FIG. 7 illustrates the entire adjustment range between 40 and 135 percent of the full-tone density or color density in the solid, subdivided into five partial ranges. The partial ranges illustrated herein are not conclusive and further partial ranges are conceivable using further parameters of the printing press. When the pressman inputs a color density percentage into the user interface 14 of the touch screen 13, the control unit or computer 12 analyzes the percentage and assigns it to the appropriate partial range. If, for example, the percentage 45 is input, this means on one hand that the rider rollers 10 must be thrown off and, on the other hand, that the temperature of the inking unit must be reduced to a minimum to obtain a value as low as 45 percent. If, in contrast, a value of 110 percent is input, this means that the rider rollers will not be disengaged, the inking unit temperature is at its maximum, and additionally, the contact strip pressure must be modified. This association of the partial ranges in FIG. 7 and the setting of the desired color density value is carried out automatically by the control unit. Due to the present invention, even in printing presses with short inking units without zones, the pressman has a wide ink feed adjustment range based on the color density in a range of between 40 and 135 percent, for example, without having to think about which technical parameters of the printing press he or she needs to adjust to obtain the desired percentage. This fact greatly simplifies operation of the printing press and avoids erroneous adjustments and thus helps to avoid waste.

The invention claimed is:

1. A method for closed-loop or open-loop control of an ink feed in an offset printing press having at least one inking unit, a control unit, an operating element for adjusting the ink feed across a predetermined ink feed control range, and a plurality of adjustment parameters of the at least one inking unit or of the printing press, the method comprising the following steps:

subdividing the predetermined ink feed control range into a plurality of partial ranges in the control unit, wherein the partial ranges do not overlap with each other;

assigning each one of the plurality of adjustment parameters of the at least one inking unit or of the printing press to only a respective one of the partial ranges in the control unit;

determining, with the control unit, an appropriate partial range as a function of the ink feed selected by the operating element; and setting, with the control unit, the selected ink feed in the at least one inking unit using the respective associated adjustment parameters in at least one of the at least one inking unit or the printing press.

2. The method according to claim 1, which further comprises adjusting the ink feed through the color density.

3. The method according to claim 1, wherein the at least one inking unit is a short inking unit of the anilox type.

4. The method according to claim 1, which further comprises automatically carrying out the closed-loop control of the ink feed with the control unit.

5. The method according to claim 1, which further comprises:

measuring color on a printing substrate with a color measuring device;

carrying out a comparison between a desired color value and the measured actual color value with the control unit; and correcting potential deviations between the desired color value and the actual color value by influencing an ink feed in the partial ranges.

6. The method according to claim 1, which further comprises setting the ink feed through an input of color density in percentages with the operating element of the control unit.

7. The method according to claim 6, which further comprises:

assigning a temperature adjustment range to a partial range of between 50 and 100 percent of a maximum range;

assigning a contact strip adjustment to a partial range of between 100 and 120 percent of the maximum range;

assigning an adjustment of a machine speed to a partial range of between 120 and 135 percent of the maximum range; and assigning a throwing off of rider rollers to a partial range of between 40 and 50% of the maximum range.

8. The method according to claim 1, which further comprises:

selecting the at least one inking unit as a short zoneless inking unit; and measuring only one actual color value with a color measuring device and comparing the actual color value to only one predetermined desired color value, for each inking unit of a printing press.

9. The method according to claim 1, which further comprises upon reducing a machine speed of the printing press for adjusting color density, providing an optical or acoustic signal to the operator of the machine with the control unit to inform the operator that a maximum production speed of the printing press is no longer available.

* * * * *